United States Patent [19]

Iwata

[11] Patent Number: 4,466,729

[45] Date of Patent: Aug. 21, 1984

[54] IMAGE FORMING APPARATUS

[75] Inventor: Yasuhiro Iwata, Yokohama, Japan

[73] Assignee: Tokyo Shibaura Denki Kabushiki Kaisha, Kawasaki, Japan

[21] Appl. No.: 426,753

[22] Filed: Sep. 29, 1982

[30] Foreign Application Priority Data

Dec. 23, 1981 [JP] Japan ..... 56-208315

[51] Int. Cl.[3] ..... G03G 15/00

[52] U.S. Cl. ..... 355/3 CH; 355/14 CH; 355/14 TR; 355/3 TR; 250/326

[58] Field of Search ..... 355/3 CH, 14 CH, 14 E, 355/14 TR, 3 TR; 250/542, 324, 325

[56] References Cited

U.S. PATENT DOCUMENTS

| | | | |
|---|---|---|---|
| 3,566,223 | 2/1971 | Salger | 355/3 CH X |
| 3,990,791 | 11/1976 | Tsukada | 355/3 R |
| 4,239,371 | 12/1980 | Igarashi et al. | 355/14 CH |
| 4,252,431 | 2/1981 | Cormier | 355/3 CH |
| 4,260,240 | 4/1981 | Pieper | 355/3 CH |
| 4,320,957 | 3/1982 | Brown et al. | 355/3 CH |
| 4,322,156 | 3/1982 | Kohyama | 355/14 CH X |
| 4,326,794 | 4/1982 | Nishimura | 355/14 CH X |

FOREIGN PATENT DOCUMENTS

| | | |
|---|---|---|
| 1811893 | 7/1969 | Fed. Rep. of Germany . |
| 2046681 | 3/1972 | Fed. Rep. of Germany . |
| 50-11040 | 2/1975 | Japan . |

*Primary Examiner*—A. C. Prescott

*Attorney, Agent, or Firm*—Cushman, Darby and Cushman

[57] ABSTRACT

A corona discharger is swingably and elastically supported in the direction contacting with or separating from a photosensitive drum always in the state urged toward the photosensitive drum side, and a supporting arm provided integrally with the corona discharger is contacted with the photosensitive drum, a shaft or relatively fixedly disposed member relative to the photosensitive drum, thereby positioning it relative to the photosensitive drum of the corona discharger. Therefore, an interval between the photosensitive drum and the corona discharger can always be maintained constant with a relatively simple structure, and can also perform always stable corona discharging operation.

15 Claims, 11 Drawing Figures

IMAGE FORMING APPARATUS

BACKGROUND OF THE INVENTION

The present invention relates to an image forming apparatus comprising a corona discharging device provided at a predetermined interval from the surface of a photosensitive body and, more particularly, to an image forming apparatus such as an electrostatic copying apparatus or an electronic printer in which a corona discharging device is used for a charger, a transfer unit and a peeling unit.

In a copying machine which employs a photosensitive body formed of selenium or cadmium sulfide, corona discharging devices (corotron) are normally disposed as a charger, a transfer unit, a sheet peeling unit and a static eliminator at positions in the vicinity of the periphery of the photosensitive body.

On the other hand, copying machines of various types have been recently developed for practical use in which, in order to facilitate removing a paper jam in the periphery of a photosensitive body, any of these corona discharging devices could have been isolated from the periphery of the photosensitive body and then been returned to the original position after the paper jam has been cleared. One such device has been proposed in which a housing of the copying machine was divided into upper and lower units substantially at the boundary of a sheet conveying passage and the upper unit was rotatably pivoted with respect to the lower unit. In this copying machine, the photosensitive body was disposed in the upper unit and corona discharging devices were disposed as a transfer unit and a peeling unit in the lower unit. In this copying machine, the upper unit was rotatably displaced as required, thereby providing a wide interval between the photosensitive body and the corona discharging devices and accordingly simplifying the paper jam removing work.

However, the relative position between the photosensitive body and the corona discharging device has heretofore been defined by the contact between frames of the upper and lower units to each other. Accordingly, the relative position between the photosensitive body and the corona discharging device might not have been constantly defined due to irregularities in the dimensional and assembling accuracy at the time of manufacture. Further, when the upper unit has been repeatedly opened and closed, the pivotal position tended to shift slightly, with the result that the relative position between the photosensitive body and the corona discharging device might have varied. Thus, the conventional corona dischargers could not have stably performed corona discharge, causing improper transfer of an image or improper peeling of a sheet as its drawbacks.

SUMMARY OF THE INVENTION

It is an object of the present invention to provide an image forming apparatus which is capable of maintaining a predetermined interval between a photosensitive body and corona dischargers with a relatively simple structure, thereby preventing improper transfer of an image or improper peeling of a sheet.

According to an aspect of the present invention, there is provided an image forming apparatus which comprises: a housing including a lower unit and an upper unit swingably supported to the lower unit; a photosensitive body housed in the housing and rotatably supported by the upper unit; a fixed member attached to the upper unit and having a fixed position relative to the photosensitive body; and a corona discharging device provided in the lower unit and including a corona charger provided with a base member fixed to the lower unit and facing the photosensitive body, a case attached to the base member being movable between the photosensitive body and the base member and opening to the photosensitive body and a charging wire housed in the case, the charging wire and photosensitive body being adapted to be connected to a power supply; urging means for moving the case in one direction toward the photosensitive body, and a positioning member fixed to the corona charger and being in contact with the fixed member to move the corona charger in a direction opposite to the one direction against the urging means when the upper unit is swung to close the housing, thereby defining the position of the corona charger relative to the photosensitive body.

More particularly, the corona charger is swingably supported to the lower unit in a direction contacting with or separating from the photosensitive body provided in the upper unit and is always elastically urged toward the photosensitive body. When the upper unit and the lower unit are combined, the positioning member provided integrally with the corona charger is contacted with the photosensitive body or a member fixed to the photosensitive body, thereby accurately positioning the corona charger to the photosensitive body.

DETAILED DESCRIPTION OF THE PREFERRED EMBODIMENTS

Figure 2:
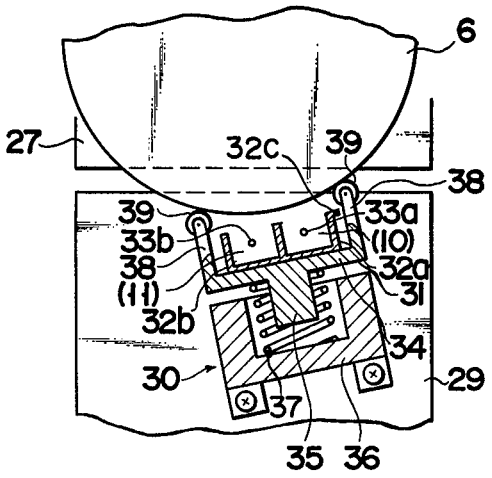
FIG. 2 is a front sectional view showing the corona discharging device shown in FIG. 1 in detail.
Figure 3:
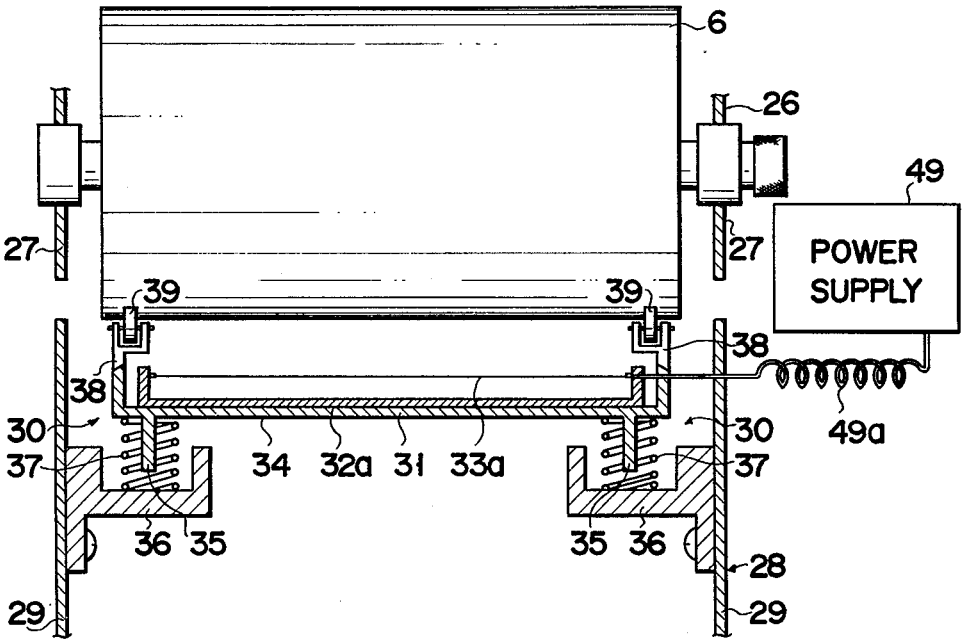
FIG. 3 is a side sectional view showing the corona discharging device shown in FIG. 1 in detail.

A first embodiment of an electrostatic copying apparatus according to the present invention will now be described in more detail with reference to the accompanying FIGS. 1 to 3.

Figure 1:
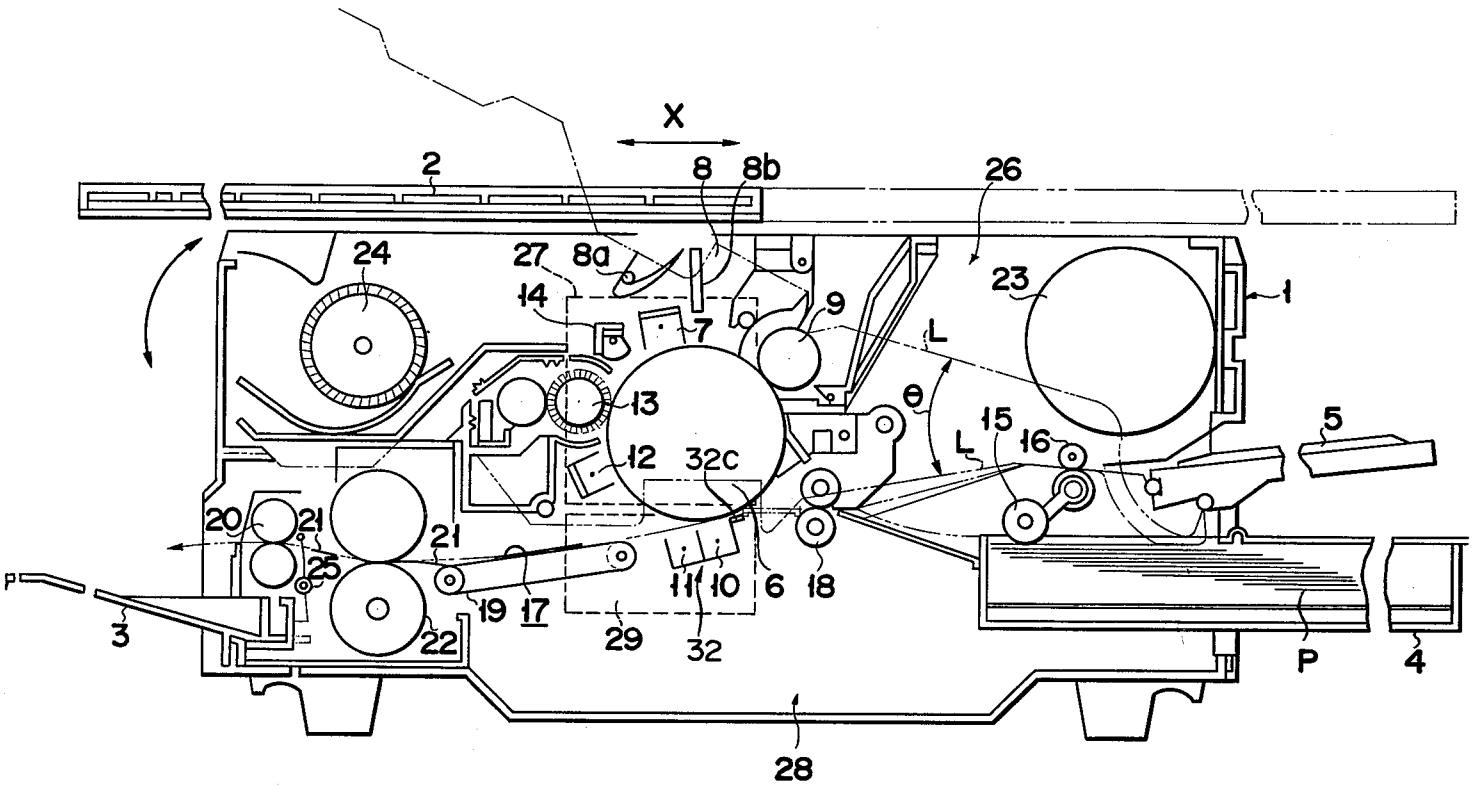
FIG. 1 is a front view schematically showing a first embodiment of an electrostatic copying apparatus according to the present invention provided with corona discharging devices as a transfer unit and a peeling unit.

FIG. 1 shows the structure of an electrostatic copying apparatus according to the present invention provided with a corona discharging device applied to a transfer unit as a peeling unit. In FIG. 1, reference number 1 designates a body of the electrostatic copying apparatus. On the upper surface of the body 1 is placed an original platform 2, which can be reciprocatedly moved in the directions indicated by arrows X as required. At the left side of the body 1 is detachably provided an exhaust sheet tray, and at the right side of the body 1 are detachably provided a cassette 4 for containing copy sheets P and a manual guide 5.

At substantially center in the body 1 is rotatably supported a photosensitive drum 6 rotatably driven in a clockwise direction. Around this photosensitive drum 6 are sequentially arranged in the rotating direction a charger 7, an exposure device 8, a developing device 9, a transfer unit 10, a peeling unit 11, a static eliminator 12, a cleaning device 13 and an after-image erasing device 14. The exposure device 8 includes an illumination system 8*a* which illuminates an original (not shown) placed on the original platform 2 and a light converging transmission device 8*b* which converges the reflected light from the original to the surface of the photosensitive drum 6.

At the right side of the body 1 are provided sheet feeding mechanisms 15 and 16. The sheet feeding mechanisms 15 and 16 respectively feed copy sheets P in the cassette 4 and copy sheets manually inserted via the manual guide 5 into a sheet conveying passage 17. This sheet conveying passage 17 extends between the sheet feeding mechanisms 15 and 16 and the exhaust sheet tray 3 in the body 1, and is formed of a pair of conveying rollers 18, a conveying belt 19, a pair of exhaust sheet rollers 20 and guide plates 21 suitably disposed therebetween. The midpoint of the sheet conveying passage 17 passes through a transfer section defined by the photosensitive drum 6 and the transfer unit 10. At the end side of the sheet conveying passage 17 are disposed a pair of fixing rollers 22.

At the upper right and left sides of the body 1 are respectively provided a motor 23 which is the prime driver of both the original platform 2 and the photosensitive drum 6, and a cooling device 24 for preventing the heater section in the body 1 from overheating. Reference numeral 25 designates an exhaust sheet detection switch provided in the vicinity of the exhaust sheet rollers 20 provided on the sheet conveying passage 17.

In the electrostatic copying apparatus thus constructed, when a copy button (not shown) is depressed, the photosensitive drum 6 is rotated clockwise in FIG. 1, and the original platform 2 is advanced in synchronization with the movement of the drum. On the other hand, a developer image corresponding to the image of the original is formed on the outer peripheral surface of the photosensitive drum 6 upon movements of the charger 7, exposure device 8 and developing device 9 disposed around the photosensitive drum 6. A copy sheet P is fed to the transfer section in synchronization with the operation of forming the developer image. The developer image is transferred to the copy sheet P by the operation of the transfer unit 10. Subsequently, the transferred copy sheet P is peeled from the photosensitive drum 6 by the operation of the peeling unit 11. The copy sheet P thus peeled is conveyed through the sheet conveying passage 17 to the exhaust sheet tray 3. Then, the developer image is fixed onto the copy sheet P by the pair of fixing rollers 22. The surface of the photosensitive drum 6 thus transferred with the developer image is cleaned by sequentially facing the static eliminator 12, cleaning device 13 and after-image erasing device 14, and is then once again faced to the charger 7.

In the meantime, the original platform 2 is returned to the original position, thus completing one copying opeation.

The body 1 of the copying apparatus thus constructed includes an upper unit 26 and a lower unit 28 formed by dividing the body 1 at the boundary of a line L substantially along the sheet conveying passage 17. The upper unit 26 is rotatably pivoted at one end to the lower unit 28 to rotatably displace upwards at an angle $\theta$ as required to be raised from the lower unit 28, and the sheet conveying passage 17 is opened. When the copy sheet P is clogged or jammed in the sheet conveying passage 17, most of the sheet conveying passage 17 can be opened by swinging the upper unit 26, and the clogged or jammed sheet P can be readily removed.

The photosensitive drum 6 is provided at a pair of frames 27 of the upper unit 26 side and the transfer unit 10 and the peeling unit 11 are provided at a pair of frames 29 of the lower unit 28 side. When the upper unit 26 is thus opened, the intervals between the photosensitive drum 6 and both the transfer unit 10 and the peeling unit 11 are increased. In the case of the first embodiment described above, the transfer unit 10 and the peeling unit 11 are respectively defined by the first and second corona discharging sections of a corona discharging device 30 as will be described later. Accordingly, in the state that the upper unit 26 is superposed with the lower unit 28, the intervals between the photosensitive drum 6 and both the transfer unit 10 and the peeling unit 11 are always maintained at the predetermined value.

The corona discharging device 30 will now be described in more detail with reference to FIGS. 2 and 3. In FIGS. 2 and 3, reference numeral 31 denotes a discharger body. In the discharger body 31 are provided in parallel two shielding cases 32*a* and 32*b* opened at the upper surfaces. In the shielding cases 32*a* and 32*b* are respectively provided discharging wires 33*a* and 33*b*. Thus, a corona discharger 34 is constructed which includes a first corona discharging section as the transfer unit 10 and a second corona discharging section as the peeling unit 11 disposed adjacent to each other.

Supporting projections 35 extending downwardly are provided on the lower surfaces of both ends of the discharger body 31 of the corona discharger 34. The supporting projections 35 are engaged with recesses of supporting members 36 which are clamped by screws to the frames 29 of the lower unit 28. In the recesses are contained coil springs 37 as elastic supporting members. The discharger body 31 is thus elastically supported via the coil springs 37. In this manner, the corona discharger 34 is swingably provided in the contacting and separating direction relative to the photosensitive drum 6 and is always urged toward the photosensitive drum 6.

At the four corners on the upper surface of the discharger body 31, supporting arms 38 extending upwards are provided as positioning members. Guide rollers 39 formed of an insulating material are rotatably journaled at the upper ends of the respective supporting arms 38. When the upper unit 26 is superposed on the lower unit 28, both side non-image forming portions of the photosensitive drum 6 mounted at the frames 27 of the upper unit 26 are slidably contacted with the respective guide rollers 39. In this manner, the corona discharger 34 having the transfer unit 10 and the peeling unit 11 as the first and second corona discharging sections can be accurately positioned. In other words, the interval between the corona discharger 34 and the photosensitive drum 6 can always be maintained constant.

Thus, according to the first embodiment of the present invention, when the mounting positions of the guide rollers 39 relative to the discharger body 31 are set to the predetermined value, the intervals between the surface of the photosensitive drum 6 and the discharging wires 33*a* and 33*b* of the first and second corona discharging sections as the transfer unit 10 and the peeling unit 11 can always be maintained constant with extremely stable corona discharging performance. As shown in FIG. 1, a paper guide member 32*c* is attached to the top of the discharger body 31. The interval between the surfaces of the photosensitive drum 6 and the paper guide member 32*c* can always be maintained constant so that the feeding path for the copying paper P is defined reliably with extremely stable corona discharging performance.

It is noted that the guide rollers 39 are rotatably driven by the rotation of the photosensitive drum 6, and a high voltage is suitably applied through a flexible power supply wire 49*a* from a high voltage power supply 49 to the discharging wires 33*a* and 33*b*.

The present invention is not limited to the particular embodiment described above. Various other changes and modifications may be made within the spirit and scope of the present invention, such as other various embodiments as shown in FIGS. 4 to 13.

Figure 4:
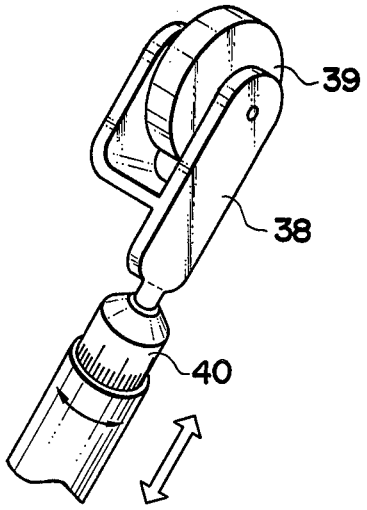
FIG. 4 is a perspective view showing a first modification of a positioning member capable of arbitrarily varying the deposition of a guide roller of the corona discharging device.

More particularly, as shown as a first modification in FIG. 4, a micrometer mechanism 40 may be associated as a control mechanism in each supporting arm 38 mounted with the guide roller 39. When the micrometer mechanism 40 is thus associated, the interval between the discharging wire 33*b* and the photosensitive drum 6 can be arbitrarily controlled. Therefore, it can facilitate the control of the corona discharging amount. The control mechanism may not always employ the micrometer mechanism 40, but may employ more simple screw mechanism so as to achieve the same object.

Figure 5:
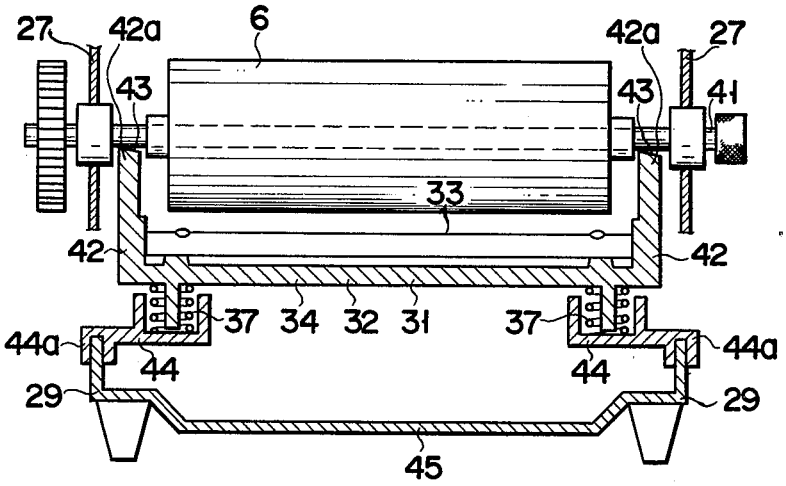
FIG. 5 is a side sectional view showing a second embodiment of the corona discharging device positioned by the shaft of a photosensitive drum.

As shown as a second embodiment of the present invention in FIG. 5, the corona discharger 34 may not always be positioned directly by the surface of the photosensitive drum 6 but also by a supporting shaft 41 for rotatably supporting the photosensitive drum 6. Thus, the guide rollers 39 may be eliminated so as to obviate the scratches on the surface of the photosensitive drum 6. Shaft contacting parts 42*a* of supporting pieces 42 as positioning members which are contacted with the supporting shaft 41 may be preferably formed of self-lubricating resin. Oblique portions 43 may be formed along the shaft inserting direction at the shaft contacting parts 42*a* so that the shaft 41 may be smoothly inserted when the shaft 41 is slidably inserted into the photosensitive drum 6. The supporting members 44 of the floating corona discharger 34 may be mounted on the frames 29 provided integrally with the lower surface base 45 of the body 1 by engaging hooks 44*a* with the frames 29.

Figure 6:
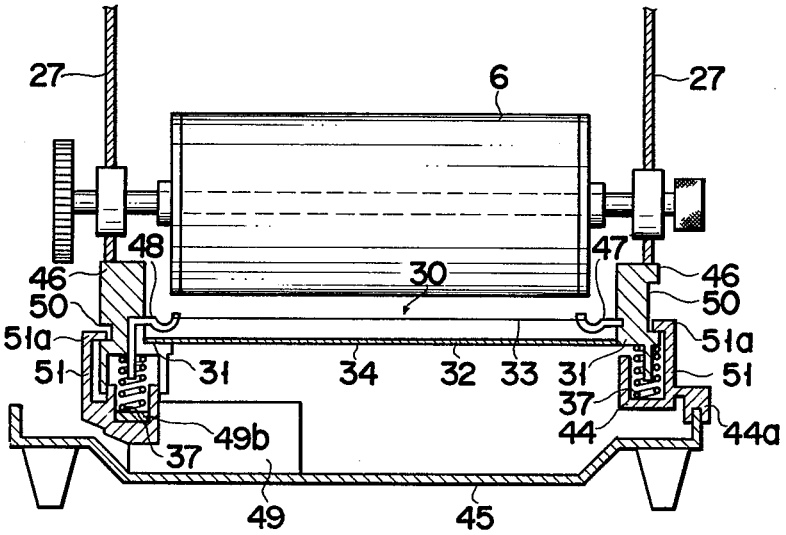
FIG. 6 is a side sectional view showing a third embodiment of the corona discharging device positioned by a frame on which the photosensitive drum is mounted.
Figure 7:
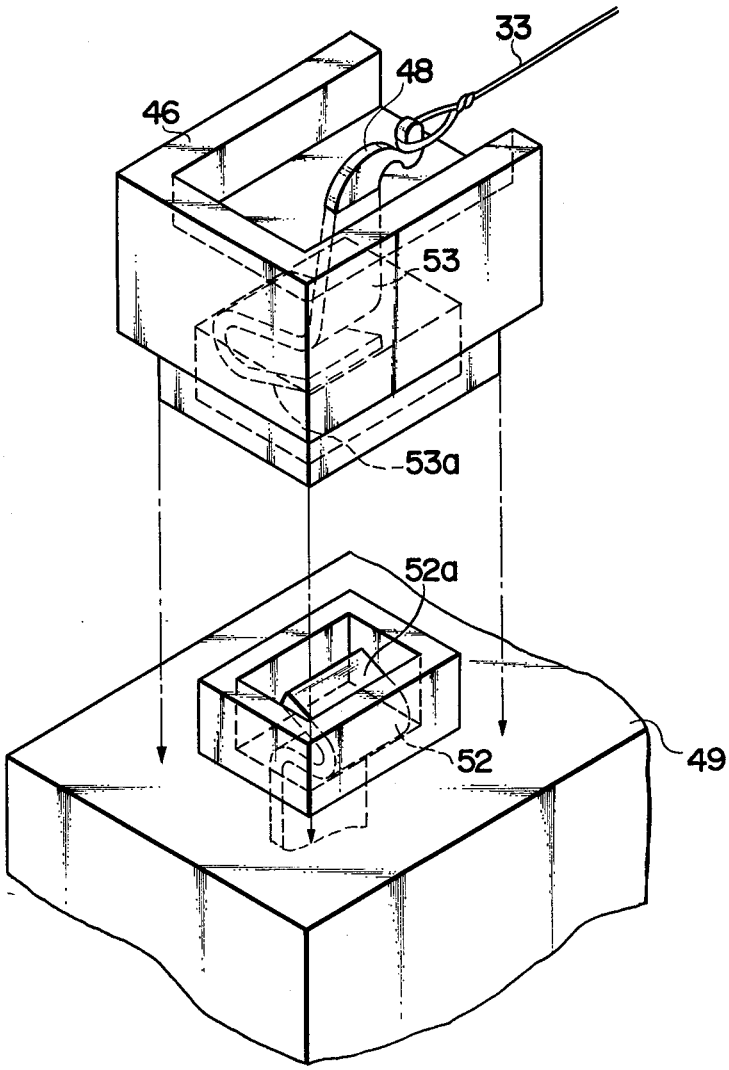
FIG. 7 is an exploded perspective view showing a fourth embodiment of a power supply member of the corona discharging device.
Figure 8:
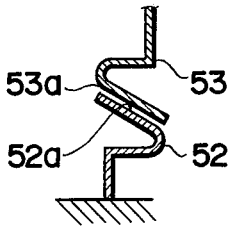
FIG. 8 is a sectional view showing a second modification of a contact member of the power supply member.

As shown as a third embodiment of the present invention in FIG. 6, a pair of supporting pieces 46 may be positioned as positioning members in contact with the pair of frames 27 of the upper unit 26 on which the photosensitive drum 6 is mounted. One of the pair of coil springs 37 may be formed as elastic supporting members of a conductive material. The discharging wire 33 is stretched via terminals 47 and 48. The one end of the one coil spring 37 is connected to the one terminal 48 for applying a voltage to the discharging wire 33, and the other end of the coil spring 37 is contacted under pressure with the power supply portion 49*b* of the high voltage power supply 49. A voltage may be applied to the discharging wire 33 with this structure. In this case, it can eliminate early damage of the power supply wire 49*a* produced due to repeated bendings when the discharging wire 33 is connected to the power supply 49 via the flexible power supply wire 49*a* as disclosed in the above first embodiment, thereby reducing the number of parts and components.

Further, a pair of engaging recesses 50 may be formed on both side faces of the discharger body 31 of the corona discharger 34 urged by the coil spring 37 as an elastic supporting member always toward the photosensitive drum 6. In this case, engaging pawls 51*a* are respectively formed at the ends of the engaging arms 51 extending from the power supply 49 and the supporting members 44 to be capable of being engaged with the engaging recesses 50. When the engaging pawls 51*a* are engaged with the engaging recesses 50, the corona discharger 34 can be restricted in movement, thereby preventing the corona discharger 34 from falling. The engaging arms 51 may be formed of elastic synthetic resin. When the arms 51 are thus formed, the corona discharging device 30 may be readily assembled merely by inserting the corona discharger 34 by elastically opening the engaging arms 51. Moreover, it not only restricts the elevational movements of the corona discharger 34 but can also simultaneously control the lateral movements of the corona discharger 34.

The power supply 49 produces a necessary high voltage from a DC power source by the known method.

In the embodiments described above, the elastic supporting members operating also as a power supply member are formed of conductive coil springs. The elastic supporting members are not limited only to this particular structure. For example, as shown as a fourth embodiment of the present invention in FIG. 7, the power supply member may have a power supply side feeder 52 and a charger side power receiver 53 both formed of a conductive leaf spring. Both the feeder 52 and the receiver 53 become capable of being energized under pressure contact with each other at the respective contacts 52*a* and 53*a* when the upper unit 26 is superposed on the lower unit 28. Further, as shown as a second modification in FIG. 8, the contacts 52*a* and 53*a* may be formed in an oblique state relative to the power supply side feeder 52 and the charger side power receiver 53. Accordingly, both the feeder 52 and the receiver 53 are slidably pressed against each other at the contacting time so that both the contacts 52*a* and 53*a* are cleaned by each other at every frictional contact, thereby preventing improper contact.

Figure 9:
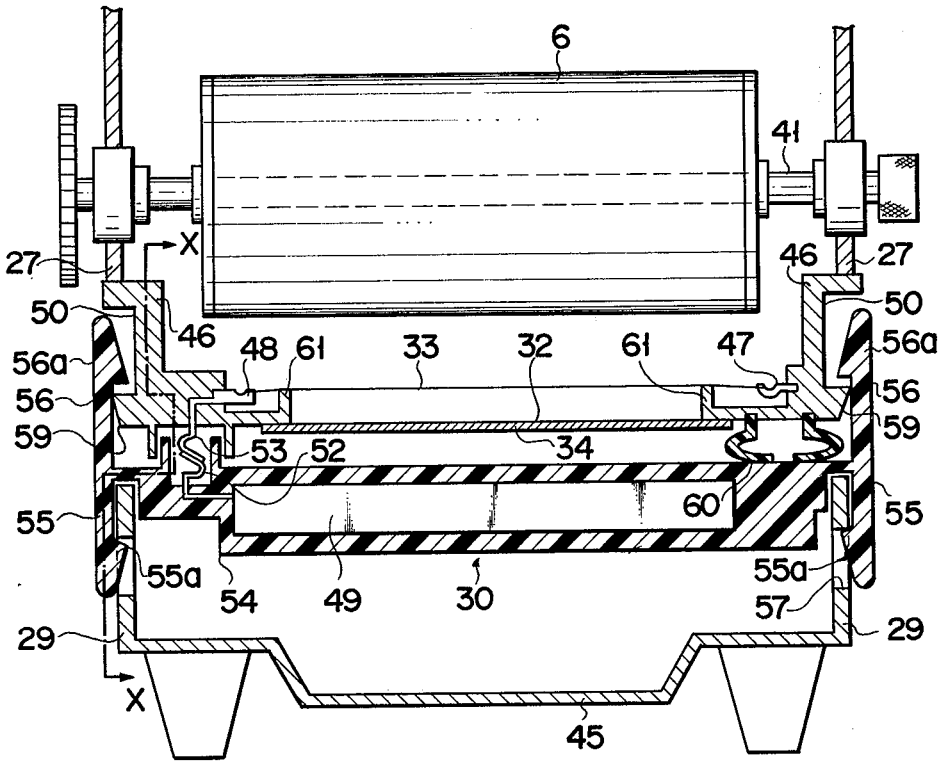
FIG. 9 is a side sectional view showing a fifth embodiment of the corona charging device having a high voltage power supply in a supporting member.
Figure 10:
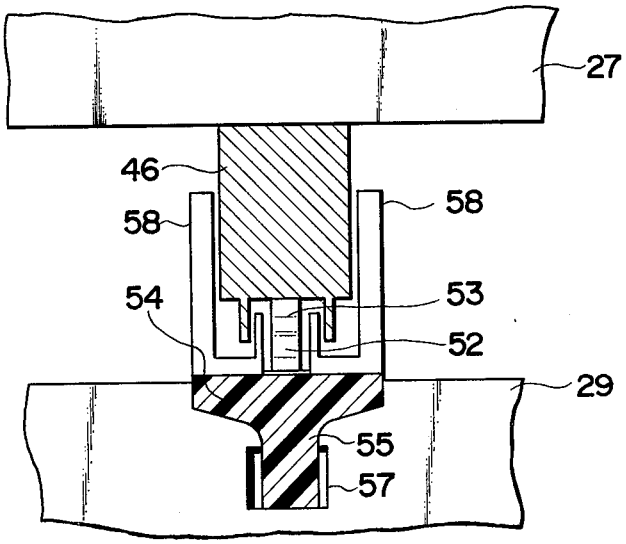
FIG. 10 is a sectional view showing the corona charging device shown in FIG. 9 taken along the line X—X.

Further, as shown as a fifth embodiment of the present invention in FIG. 9 and FIG. 10 in the cross section along the line X—X in FIG. 9, the corona discharger 34 may be supported by the supporting members 54. The supporting members 54 contain the power supply 49 therein. The voltage produced from the power supply 49 is applied to the power supply side feeder 52. The supporting members 54 may be formed of elastic synthetic resin, and upper and lower engaging arms 55 and 56 may be respectively formed at both ends. The engaging pawls 55*a* of the lower engaging arms 55 are engaged with the engaging holes 57 formed at the frames 29 formed integrally with the lower base 45 of the lower unit 28. The supporting members 54 are fixed to the frames 47 by this engagement. The corona discharger 34 is provided between the both upper engaging arms 56, and the engaging pawls 56*a* are engaged with the engaging recesses 50 formed of the outside surfaces of the supporting pieces 46. The elevational and lateral movements of the corona discharger 34 may be restricted by this engagement. In addition, as shown in FIG. 10, stopper members 58 are formed integrally at both ends of the supporting members 54. The lateral movements and the swingable rotation of the corona discharger 34 in FIG. 10 can be controlled. Oblique parts are formed similar to the oblique parts of the engaging pawls 56*a* of the engaging arms 56 at the portions corresponding to the engaging recesses 50 of both ends of the discharger body 31. With this structure, the corona discharger 31 can be associated with the supporting members 54 by one-touch operation. After the corona discharger 34 is associated with the supporting members 54, the discharger body 31 is pushed upward by the repelling force between the power supply side feeder 52 and the charger side receiver 53 formed of a conductive leaf spring at the contacting time and also by the repelling force between the elastic pieces 60 formed on the lower surface of the discharge body 31 and the supporting members 54. However, the corona discharger 34 will not fall because of the engagement of the engaging pawls 56*a* of the engaging arms 56 with the engaging recesses 50. Both the elastic pieces 60 may be formed of resin integral with the discharger body 31, or may be formed of another member and may be mounted with the member, or may be mounted not at the discharger body 31 side but at the supporting members 54.

In the corona discharging device 30 thus constructed, when the upper unit 26 is integrally associated with the lower unit 28, the frames 27 are lowered and are contacted with the upper surfaces of the positioning members 46 of the discharger body 31, thereby pressing them down. The relative positional relationship between the corona discharger 34 and the frames 27 can be accurately determined by this depression. Further, the interval between the frames 27 and the photosensitive drum 6 is predetermined, and the height of the discharging wires 33 provided between the terminals 48 and 47 may be controlled by a pair of height determining members (which includes eccentric screws (not shown) or other controlling mechanisms). Thus, the interval between the photosensitive drum 6 and the discharging wire 3 may be maintained constant.

Figure 11:
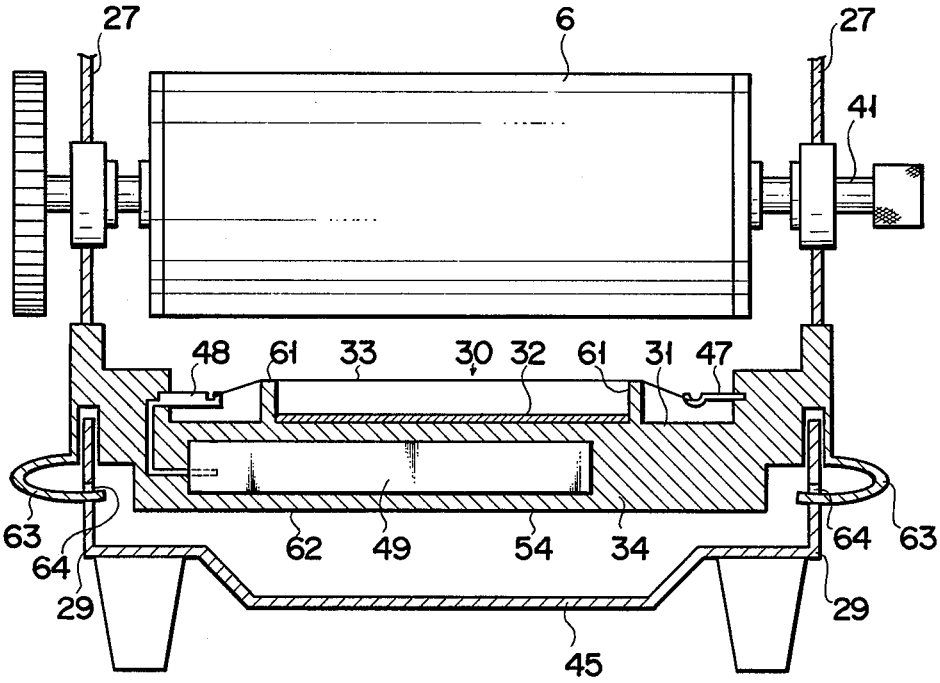
FIG. 11 is a side sectional view showing a sixth embodiment of the corona charging device integrally formed with a discharger body and a supporting member.

As further shown as a sixth embodiment of the present invention in FIG. 11, the discharger body 31 of the corona discharger 34 and the supporting members 54 may be formed integrally. Unit supporting members 63 having elasticity are formed at both ends of the discharging unit 62. The end parts of the unit supporting members 63 may be engaged with the engaging holes 64 formed at the frames 29. The discharging units 62 may be elastically supported by this engagement. The discharging units 62 may be formed integrally with the discharger body 31 and the supporting members 54, or may be formed of suitable material integrally. Since the same unit has the corona discharger 34, the power supply 49 and the unit supporting members 63 integrally, the adjustment of the unit can be readily performed, and the assembling and mounting of the discharging device can be simply performed, thereby largely reducing the number of steps of assembling and adjusting the copying apparatus. Also, contact points through which high voltage passes are omitted.

In the embodiments described above, this invention is applied to the copying apparatus. However, the present invention is not limited only to the particular embodiments, but may also be applied to any image forming apparatus in which a corona discharging device is disposed at the position at least adjacent to the surface of the photosensitive drum.

Further, various other changes and modifications may be made within the spirit and scope of the present invention.

In the embodiments described above, the members described in the previous embodiments and the members described already in the previous description are designated with the same or equivalent reference numerals and the description of these members are omitted.

In the embodiments described above, the present invention comprises the corona discharger which is swingably and elastically supported in the direction contacting with or separating from the photosensitive drum always in the state urged toward the photosensitive drum side, and the positioning member which is provided integrally with the corona discharger and is contacted with the photosensitive drum or the member relatively fixedly disposed relative to the photosensitive drum, thereby positioning it relative to the photosensitive drum of the corona discharger. Therefore, the interval between the photosensitive drum and the corona discharger can always be maintained constant with a relatively simple structure, and can also perform always stable corona discharging operation.

What is claimed is:

1. An image forming apparatus comprising:

a housing including a first unit and a second unit swingably supported to the first unit;

a photosensitive body housed in the housing and rotatably supported by the second unit;

a fixed member attached to the second unit and having a fixed position relative to the photosensitive body; and a corona charging device provided in the first unit and including:

a corona charger provided with a base member fixed to the first unit and facing the photosensitive body, a case attached to the base member, being movable between the photosensitive body and the base member and opening to the photosensitive body and a charging wire housed in the case, said charging wire and photosensitive body being adapted to be connected to a power supply, urging means for moving the case in one direction toward the photosensitive body, and a positioning member fixed to said corona charger and being in contact with said fixed member to move the corona charger in a direction opposite to said one direction against the urging means when the second unit is swung to close the housing, thereby defining the position of the corona charger relative to the photosensitive body.

2. The image forming apparatus according to claim 1, wherein said fixed member is formed of a part of the surface of the photosensitive body.

3. The image forming apparatus according to claim 1, wherein said photosensitive body has a shaft for rotatably supporting the photosensitive body, and said fixed member is formed of a part of the shaft.

4. The image forming apparatus according to claim 1, wherein said fixed member is formed of a part of the second unit.

5. The image forming apparatus according to claim 2, wherein said positioning member is fixed to the case.

6. The image forming apparatus according claim 5, wherein said positioning member has a rotatable roller at a part contacted with the surface of said photosensitive body.

7. The image forming apparatus according to claim 3, wherein said positioning member is secured to the case.

8. The image forming apparatus according to claim 7, wherein said positioning member has an inclined surface at the part contacted with said shaft.

9. The image forming apparatus according to claim 4, wherein said positioning member is secured to the case.

10. The image forming apparatus according to claim 1, wherein said urging means has at least two elastic members springs for urging the case toward the photosensitive member, arranged between the case and the base member.

11. The image forming apparatus according to claim 10, wherein said each elastic member includes a coil spring.

12. The image forming apparatus according to claim 11, wherein at least one of said coil springs is formed of a conductive material, one end of said coil spring is connected to one end of said charging wire, and the other end of said coil spring is connected to said power supply.

13. The image forming apparatus according to claim 1, wherein said urging means has a first leaf spring secured to the case, and a second leaf spring secured to the base member, said first and second leaf springs are contacted with each other when the second unit is swung to close the housing, thereby urging the case toward the photosensitive body.

14. The image forming apparatus according to claim 13, wherein said first and second leaf springs are both formed of a conductive material, the first leaf spring is connected to the charging wire, and the second leaf spring is connected to the power supply.

15. The image forming apparatus according to claim 1, wherein said power is provided in the case.

* * * * *